US006131234A

United States Patent [19]

Chen

[11] Patent Number: 6,131,234

[45] Date of Patent: Oct. 17, 2000

[54] FLOWER-LIKE BATHING IMPLEMENT

[76] Inventor: Ching-Chen Chen, No. 552 Kuang Fu Rd., Pei Tou., Chang Hua Hsien, Taiwan

[21] Appl. No.: 09/248,978

[22] Filed: Feb. 12, 1999

[51] Int. Cl.[7] ..... A47L 13/10

[52] U.S. Cl. ..... 15/229.11; 15/209.1; 15/229.13

[58] Field of Search ..... 15/209.1, 229.11, 15/229.12, 229.13

[56] References Cited

U.S. PATENT DOCUMENTS

| | | | |
|---|---|---|---|
| 1,533,868 | 4/1925 | Kingman | 15/229.11 |
| 1,851,237 | 3/1932 | Bradford | 15/229.11 |
| 1,853,542 | 4/1932 | Bradford | 15/229.12 |
| 1,963,529 | 6/1934 | Protz | 15/229.12 |
| 2,581,779 | 1/1952 | Abraham | 15/229.11 |
| 3,343,196 | 9/1967 | Barnhouse | 15/229.11 |
| 4,462,135 | 7/1984 | Sanford | 15/229.12 |
| 5,709,434 | 1/1998 | Chen | 300/21 |
| 5,727,277 | 3/1998 | Chien | 15/229.11 |
| 5,740,599 | 4/1998 | Chang | 300/21 |
| 5,758,386 | 6/1998 | Chen | 15/229.11 |
| 5,946,780 | 9/1999 | Brocherds et al. | 300/21 |

*Primary Examiner*—Terrence R. Till
*Attorney, Agent, or Firm*—Dougherty & Troxell

[57] ABSTRACT

A flower-like bathing implement which includes an elastic tube of net arranged into the shape of an axially peripherally wrinkled short cylinder; a first binding element inserted through the elastic tube of net and tied up, forming a first tied point at the elastic tube; a second binding element wound round the elastic tube of net and tied up, forming a second tied point spaced from the first tied point at a distance, the second binding element having a part extended over top and bottom sides of the elastic tube and tied up, forming a third tied point at the elastic tube of net adjacent the second tied point; a first expansion portion formed of a part of the elastic tube of net between the first tied point and the second tied point; a second expansion portion formed of the other part of the elastic tube of net and shaped like a flower expanded in all directions from the second binding element.

6 Claims, 5 Drawing Sheets

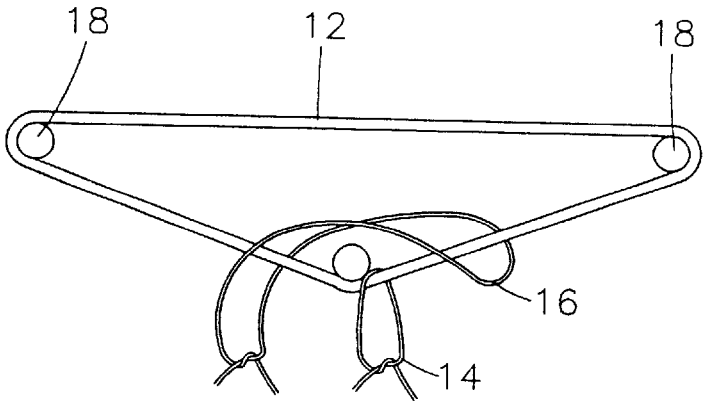
FIG. 3-A
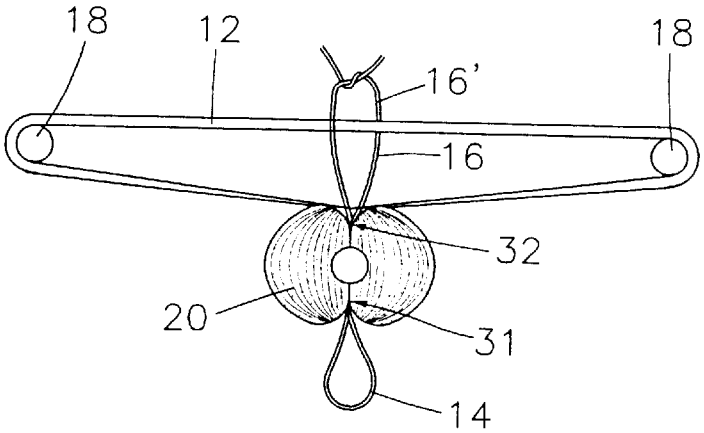
FIG. 3-B
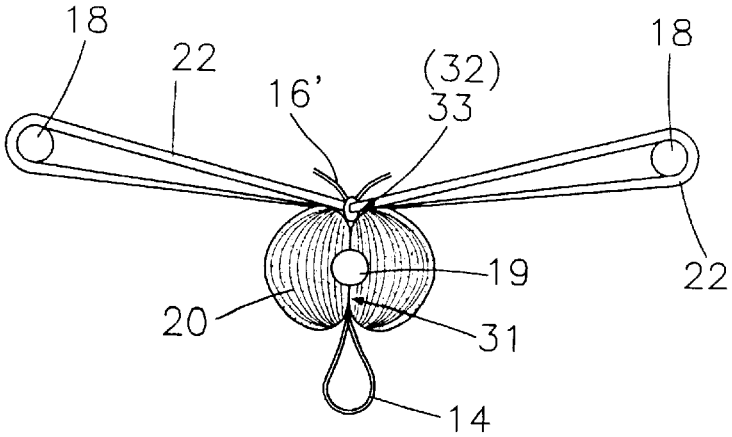
FIG. 3-C

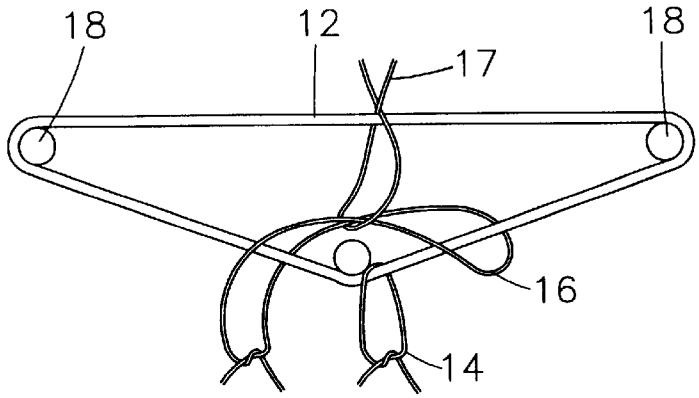
FIG. 5–A
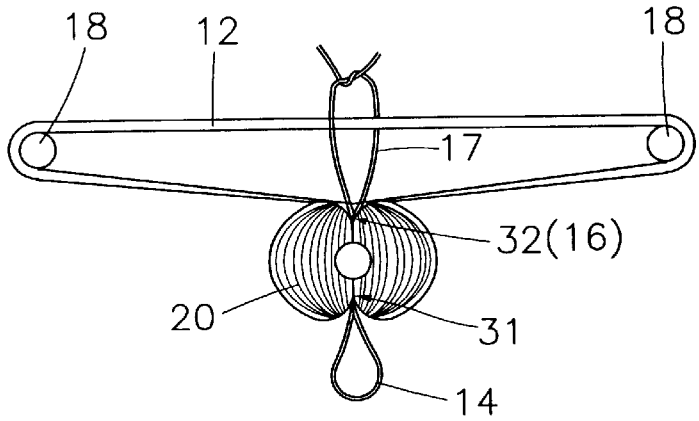
FIG. 5–B
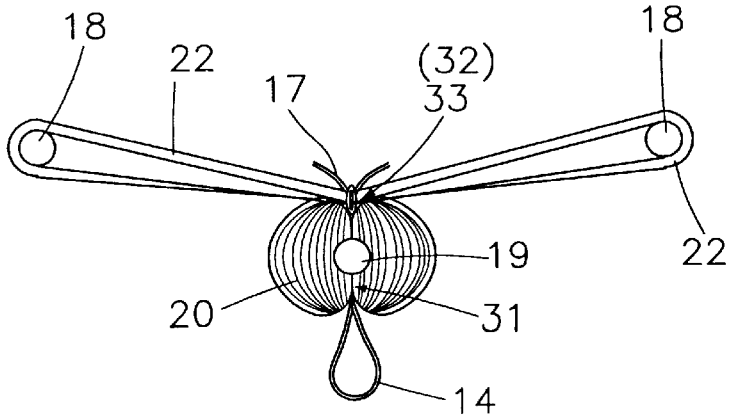
FIG. 5–C

FLOWER-LIKE BATHING IMPLEMENT

BACKGROUND OF THE INVENTION

The present invention relates to bathing implements, and more particularly to a flower-like bathing implement that can be closely attached to the skin of the body, and smoothly rubbed against the skin of the body to remove dirt from the skin of the body effectively.

Various hall-like bathing implements for brushing the body have been disclosed, and have appeared on the market. U.S. Pat. No. 5,144,744 discloses a similar bathing implement. This design of bathing implement achieves a satisfactory cleaning effect. However, because the whole bathing implement is shaped like a bulky, soft ball, it is difficult to hold the bathing implement in hand when rubbing it over the skin of the body. There is known another kind of bathing implement formed by compressing an elastic tube of net, and then tying up the compressed elastic tube of net into two linked balls. When in use, one of the linked balls is for grasping by hand, and the other ball is for rubbing again the skin of the body. However, because the two balls are not so bulky and expand uniformly, it is difficult to closely attach one of the ball to the skin and positively rubbed against the skin of the body in controlled direction.

SUMMARY OF THE INVENTION

It is one object of the present invention to provide a flower-like bathing implement which can be positively held in hand and smoothly positively rubbed against the skin of the body. It is another object of the present invention to provide a flower-like bathing implement which has a wrinkled flower-like expansion portion that can be closely attached to the skin of the body to achieve a satisfactory cleaning effect. To achieve these and other objects of the present invention, there is provided a flower-like bathing implement, which is comprised of an elastic tube of net arranged into the shape of an axially peripherally wrinkled short cylinder; a first binding element inserted through the elastic tube of net and tied up, forming a first tied point at the elastic tube; a second binding element wound round the elastic tube of net and tied up, forming a second tied point spaced from the first tied point at a distance, the second binding element having a part extended over top and bottom sides of the elastic tube and tied up, forming a third tied point at the elastic tube of net adjacent the second tied point; a first expansion portion formed of a part of the elastic tube of net between the first tied point and the second tied point; a second expansion portion formed of the other part of the elastic tube of net and shaped like a flower expanded in all directions from the second binding element.

BRIEF DESCRIPTION OF THE DRAWINGS

FIGS. 3A–3C show the installation procedure of the first rope-like binding element and the second rope-like binding element according to the present invention.

FIG. 5A–5C show the installation procedure of the first, second, and third rope-like binding elements according to the present invention.

DETAILED DESCRIPTION OF THE PREFERRED EMBODIMENT

Figure 1:
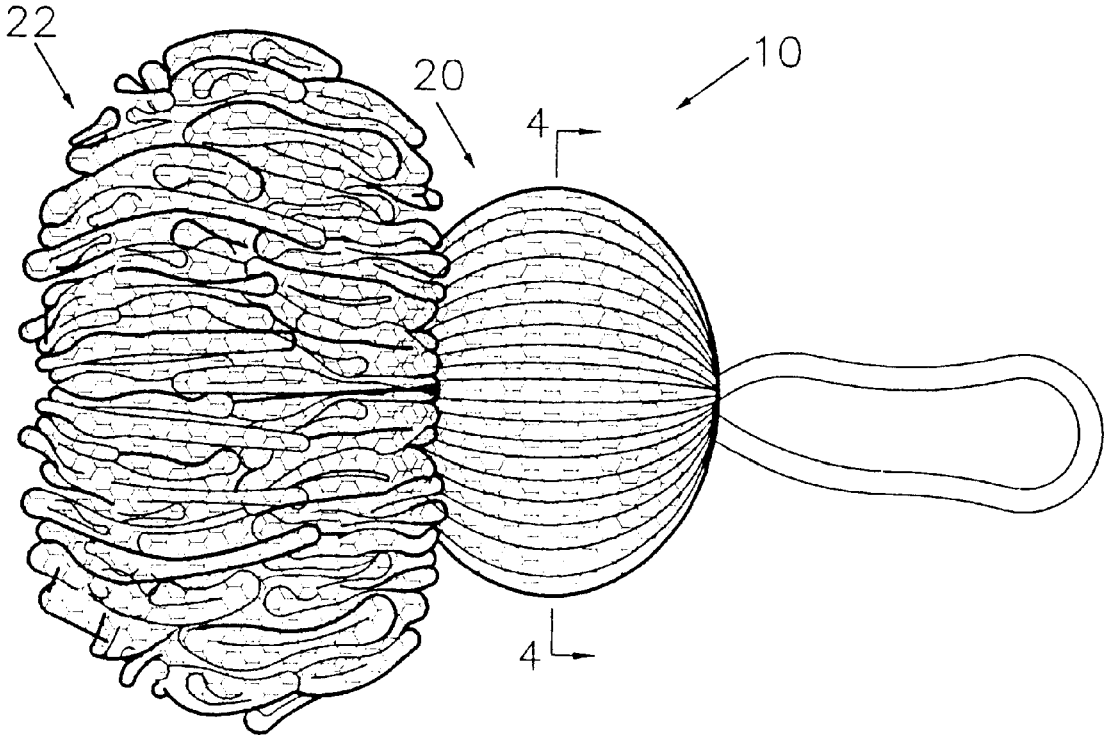
FIG. 1 is a perspective view of a flower-like bathing implement according to the present invention.
Figure 2:
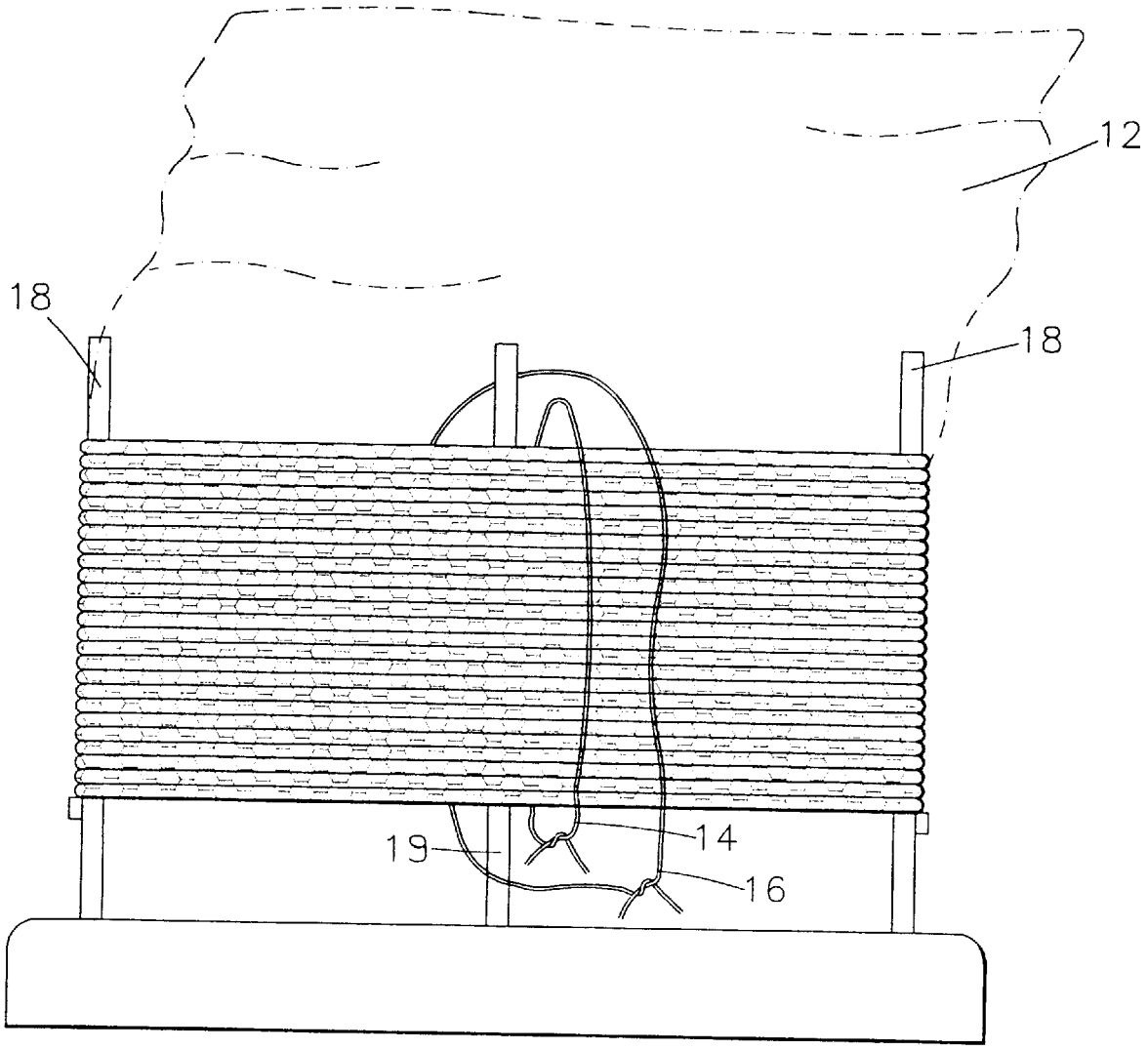
FIG. 2 illustrates the elastic tube of net pulled over the first fixed upright rod members and the second fixed upright rod members, the first rope-like binding element and the second rope-like binding element attached to the elastic tube of net according to the present invention.
Figure 4:
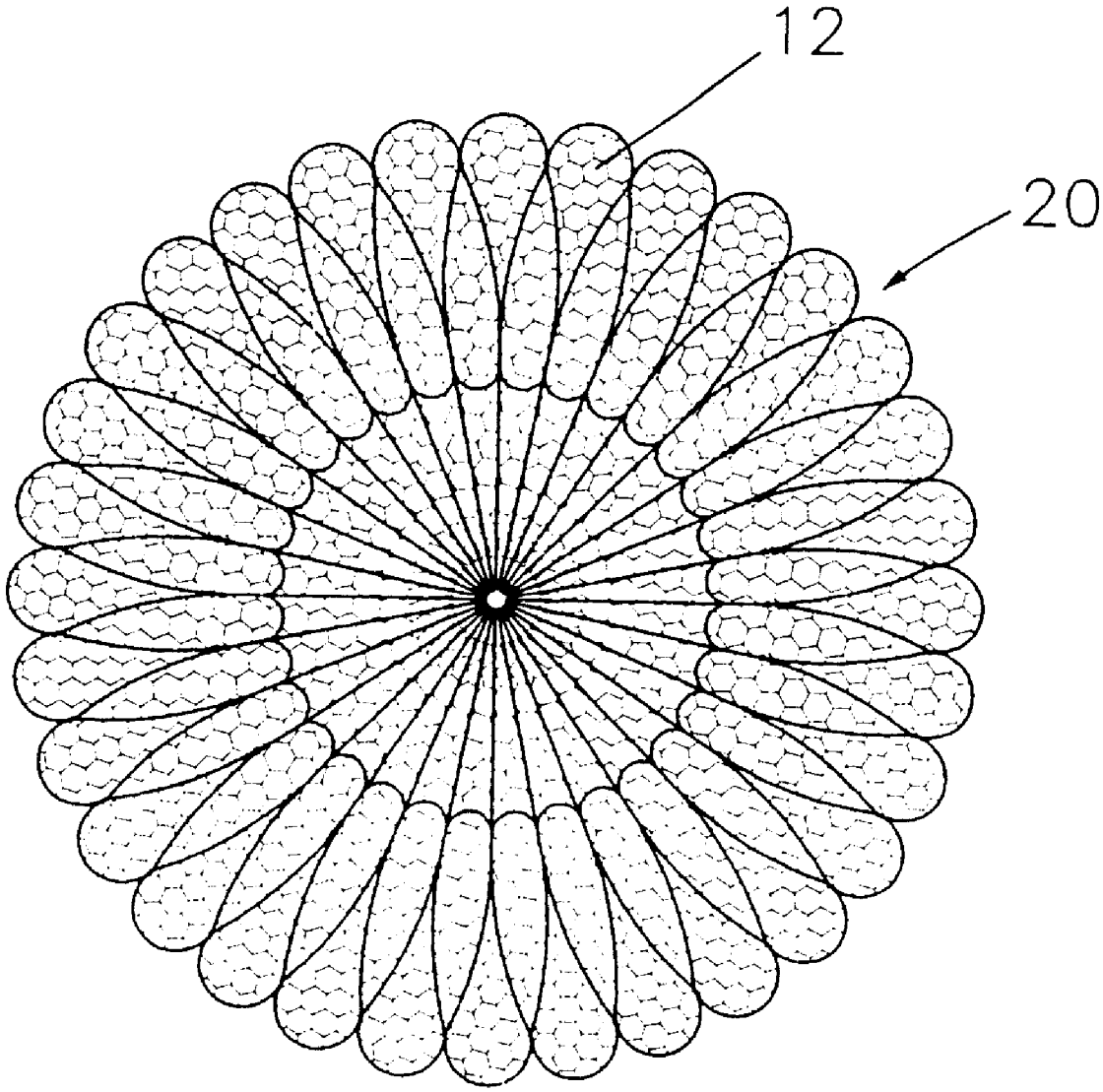
FIG. 4 is a sectional view taken along line 4—4 of FIG.

Referring to Figures from 1 through 4, a flower-like bathing implement 10 in accordance with the present invention is generally comprised of an elastic tube of net 12, a first rope-like binding element 14, and a second rope-like binding element 16.

The elastic tube of net 12 is made in integrity having a certain length and certain size of rhombic or rectangular meshes. When making the bathing implement 10, the elastic tube of net 12 is pulled over a pair of first fixed upright rod members 18 and a second fixed upright rod member 19. The fixed upright rod members 18 and 19 are respectively disposed at the angles of a triangle. The second fixed upright rod member 19 is equally spaced between the first fixed upright rod members 18 at an angle. When the elastic tube of net 12 is stretched and pulled over the fixed upright rod members 18 and 19, it is continuously pushed downwards, and arranged into the shape of an axially peripherally wrinkled short cylinder. The first rope-like binding element 14 is then inserted through the axial center open defined within the short cylinder of the elastic tube of net 12, and then tied up at the location adjacent to the second fixed upright rod member 19, forming a first tied point 31. The second rope-like binding element 16 is then wound round the short cylinder of the elastic tube of net 12 adjacent to the second fixed upright rod member 19 and tied up, forming a second tied point 32. The ends 16' of the second rope-like binding element 16 are then extended over the short cylinder of the elastic tube of net 12 from top and bottom sides, and then tied up, forming a third tied point 33 linked to the second tied point 32. The binding of the first rope-like binding element 14 and the second rope-like binding element 16 at the first tied point 31, second tied point 32 and third tied point 33 enables the material of the elastic tube of net 12 to expand and form, after removal of the short cylinder of the elastic tube of net 12 from the fixed upright rod members 18 and 19, a first expansion portion 20 between the first tied point 31 and the second tied point 32, and a second expansion point 22 at one side of the first expansion portion 20 opposite to the first rope-like binding element 14.

The first expansion portion 20 is formed of a part of the elastic tube of net 12 between the first rope-like binding element 14 and the second rope-like binding element 16. It is less bulky than the second expansion portion 22, and suitable for the holding of the hand. The second expansion portion 22 is formed of the major part of the elastic tube of net 12, and expanded in different directions from the second tied point 32 and third tied point 33. After removal of the short cylinder of elastic tube of net 12 from the fixed upright rod members 18 and 19, the first expansion portion 20 is shaped like a collapsible ball, and the second expansion portion 22 is shaped like a wrinkled flower (the technique of forming a wrinkled flower is explained in U.S. Pat. No. 5,709,434, issued to the present inventor).

The second expansion portion 22 is formed of two symmetrical halves, it can be closely attached to the skin of the body and smoothly rubbed against the skin of the body. Because the corrugated periphery of the elastic tube of net 12 at the second expansion portion 22 expands in different directions, the meshes go in all directions when the second expansion portion 22 is rubbed against the skin of the body, dirt can effectively be removed from the skin of the body.

Furthermore, a third rope-like binding element 17,as shown in FIGS. 5A–5C may be used and to tie up the short cylinder of the elastic tube 12, achieving the effect of the ends 16' of the second rope-like binding element 16.

It is to be understood that the drawings are designed for purposes of illustration only, and various modifications and changes could be made thereunto without departing from the spirit and scope of the invention disclosed.

What the invention claimed is:

1. A flower-like bathing implement comprising:

an elastic tube of net arranged into the shape of an axially peripherally wrinkled short cylinder;

a first binding element inserted through said elastic tube of net and tied up, forming a first tied point at said elastic tube;

a second binding element wound round said elastic tube of net and tied up, forming a second tied point spaced from said first tied point at a distance, said second binding element having a part extended over top and bottom sides of said elastic tube and tied up, forming a third tied point at said elastic tube of net adjacent said second tied point;

a first expansion portion formed of a part of said elastic tube of net between said first tied point and said second tied point;

a second expansion portion formed of the other part of said elastic tube of net and shaped like a flower expanded in all directions from said second binding element.

2. The flower-like bathing implement of claim 1 wherein said first binding element and said second binding element are flexible, rope-like members.

3. A flower-like bathing implement comprising:

an elastic tube of net arranged into the shape of an axially peripherally wrinkled short cylinder;

a first binding element inserted through said elastic tube of net and tied up, forming a first tied point at said elastic tube;

a second binding element wound round said elastic tube of net and tied up, forming a second tied point spaced from said first tied point at a distance, said second binding element having a free end extended over top and bottom sides of said elastic tube of net and fastened up to tie up said elastic tube of net, forming a third tied point at said elastic tube of net adjacent said second tied point;

a first expansion portion formed of a part of said elastic tube of net between said first tied point and said second tied point;

a second expansion portion formed of the other part of said elastic tube of net and shaped like a flower expanded in all directions from said second binding element.

4. The flower-like bathing implement of claim 3 wherein said first binding element and said second binding element are flexible, rope-like members.

5. A flower-like bathing implement comprising:

an elastic tube of net arranged into the shape of an axially peripherally wrinkled short cylinder;

a first binding element inserted through said elastic tube of net and tied up, forming a first tied point at said elastic tube;

a second binding element wound round said elastic tube of net and tied up, forming a second tied point spaced from said first tied point at a distance;

a third binding element fastened to said second binding element and extended over top and bottom sides of said elastic tube and tied up, forming a third tied point at said elastic tube of net adjacent said second tied point;

a first expansion portion formed of a part of said elastic tube of net between said first tied point and said second tied point;

a second expansion portion formed of the other part of said elastic tube of net and shaped like a flower expanded in all directions from said second tied point and said third tied point.

6. The flower-like bathing implement of claim 5 wherein said first binding element, said second binding element and said third binding element are flexible, rope-like members.

* * * * *